US008016546B2

(12) United States Patent
Surace et al.

(10) Patent No.: US 8,016,546 B2
(45) Date of Patent: Sep. 13, 2011

(54) SYSTEMS AND METHODS FOR PROVIDING VANE PLATFORM COOLING

(75) Inventors: Raymond Surace, Newington, CT (US); Eleanor D. Kaufman, Cromwell, CT (US); Andrew D. Milliken, Middletown, CT (US); William Abdel-Messeh, Middletown, CT (US)

(73) Assignee: United Technologies Corp., Hartford, CT (US)

( * ) Notice: Subject to any disclaimer, the term of this patent is extended or adjusted under 35 U.S.C. 154(b) by 1362 days.

(21) Appl. No.: 11/782,001

(22) Filed: Jul. 24, 2007

(65) Prior Publication Data

US 2009/0028692 A1 Jan. 29, 2009

(51) Int. Cl.
*F01D 25/12* (2006.01)

(52) U.S. Cl. ..... 415/115; 416/193 A

(58) Field of Classification Search ..... 416/193 A
See application file for complete search history.

(56) References Cited

U.S. PATENT DOCUMENTS 3,800,864 A * 4/1974 Hauser et al. ..... 415/115
4,017,213 A * 4/1977 Przirembel ..... 415/115
4,288,201 A 9/1981 Wilson
4,820,116 A 4/1989 Hovan et al.
5,288,207 A 2/1994 Linask
5,344,283 A 9/1994 Magowan et al.
5,669,759 A 9/1997 Beabout
6,254,333 B1 * 7/2001 Merry ..... 415/115
6,589,010 B2 7/2003 Itzel et al.
6,773,230 B2 8/2004 Bather et al.
6,824,352 B1 11/2004 Moore et al.
6,955,523 B2 10/2005 McClelland
7,004,720 B2 2/2006 Synnott et al.
7,118,326 B2 10/2006 Liang
2004/0109765 A1 * 6/2004 Benedetti et al. ..... 416/97 R
2005/0281663 A1 * 12/2005 Trindade et al. ..... 415/1

* cited by examiner

*Primary Examiner* — Richard Edgar
(74) *Attorney, Agent, or Firm* — Carlson, Gaskey & Olds PC

(57) ABSTRACT

Systems and methods for cooling vane platforms are provided. In this regard, a representative method for cooling a vane platform includes: providing a cooling channel on a platform from which a vane airfoil extends, the cooling channel being defined by a cooling surface and a channel cover, the channel wall being spaced from the cooling surface and located such that the cooling surface is positioned between a gas flow path of the vane and the channel cover; and directing a flow of cooling air through the cooling channel such that heat is extracted from the cooling surface of the platform by the flow of cooling air.

20 Claims, 3 Drawing Sheets

SYSTEMS AND METHODS FOR PROVIDING VANE PLATFORM COOLING

BACKGROUND

1. Technical Field

The disclosure generally relates to gas turbine engines.

2. Description of the Related Art

Since turbine gas flow path temperatures can exceed 2,500 degrees Fahrenheit, cooling schemes typically are employed to cool the platforms that are used to mount turbine vanes and bound the turbine gas flow path. Two conventional methods for cooling vane platforms include impingement cooling and film cooling. Notably, these methods require the formation of cooling holes through the vane platforms.

In operation, there are times during which the pressure of available cooling air is less than that of the static pressure along the turbine gas flow path. Therefore, an insufficient back flow margin can exist that may result in hot gas ingestion into the vane platform cavity via the cooling holes.

SUMMARY

Systems and methods for cooling vane platforms are provided. In this regard, an exemplary embodiment of a method for cooling a vane platform comprises: providing a cooling channel on a platform from which a vane airfoil extends, the cooling channel being defined by a cooling surface and a channel cover, the channel cover being spaced from the cooling surface and located such that the cooling surface is positioned between a gas flow path of the vane and the channel cover; and directing a flow of cooling air through the cooling channel such that heat is extracted from the cooling surface of the platform by the flow of cooling air.

An exemplary embodiment of a gas turbine vane assembly comprises: a vane platform having a vane mounting surface and a cooling channel; and a vane airfoil extending outwardly from the platform; the cooling channel being defined by a cooling surface and a channel cover, the channel cover being spaced from the cooling surface and located such that the cooling surface is positioned between a gas flow path of the vane airfoil and the channel cover, the channel having a cooling inlet located in a high pressure region of the platform and a cooling outlet located in a low pressure region of the platform such that during operation, cooling air flows into the cooling inlet, through the cooling channel and out of the cooling outlet.

An exemplary embodiment of a gas turbine engine comprises: a compressor section; a combustion section located downstream of the compressor section; and a turbine section located downstream of the combustion section and having multiple vane assemblies; a first of the vane assemblies having a platform and a vane airfoil, the platform having a vane mounting surface and a cooling channel; the cooling channel being defined by a cooling surface and a channel cover, the channel cover being spaced from the cooling surface, the cooling surface being positioned between a gas flow path of the vane and the channel cover, the channel having a cooling air inlet located in a high pressure region of the platform and a cooling air outlet located in a low pressure region of the platform such that, during operation, cooling air flows into the cooling air inlet, through the cooling channel and out of the cooling air outlet without flowing into the vane airfoil.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

As will be described in detail here, systems and methods for cooling turbine vane platforms are provided. In this regard, several embodiments will be described that generally involve the use of cooling channels for directing cooling air. Specifically, the cooling air is directed to flow in a manner that can result in enhanced convective cooling of a portion of a vane platform. In some of these embodiments, surface cooling features are provided on a cooling surface of the vane platform to enhance heat transfer. By way of example, protrusions can be located on the cooling surface to create a desired flow field of air within a cooling channel.

Figure 1:
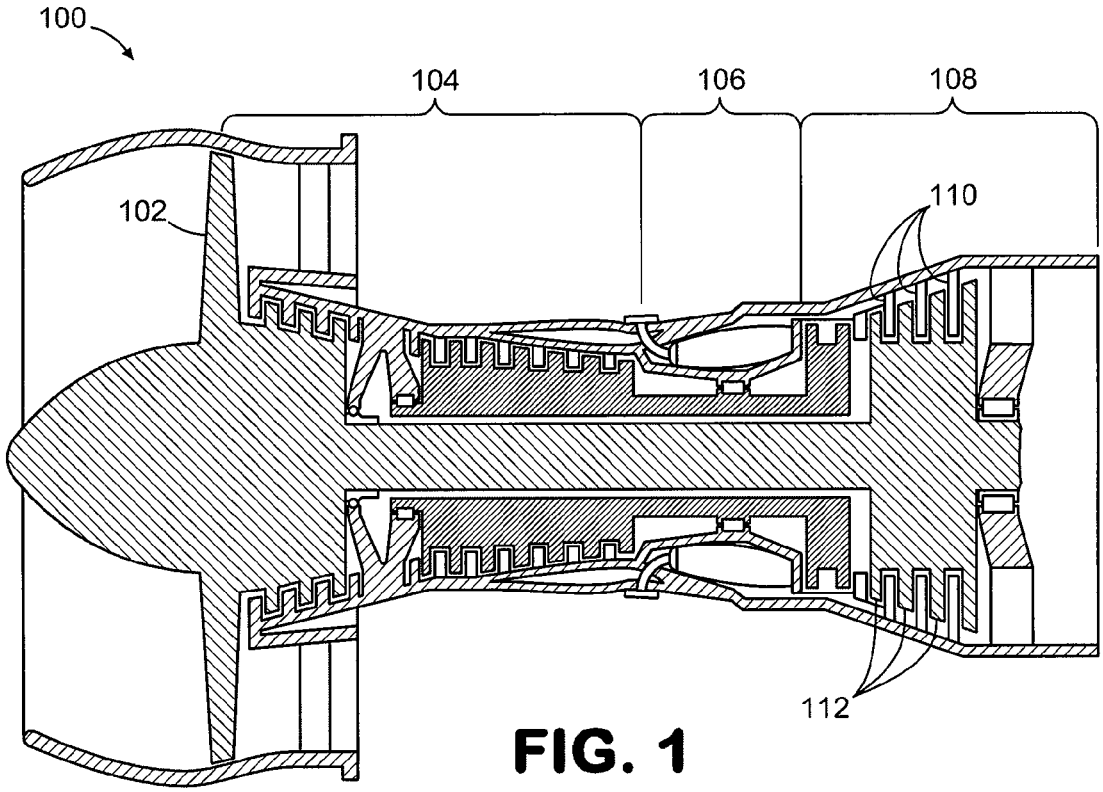
FIG. 1 is a schematic cross-sectional view of an embodiment of a gas turbine engine.

Referring now to the drawings, FIG. 1 is a schematic diagram depicting a representative embodiment of a gas turbine engine 100. Although engine 100 is configured as a turbofan, there is no intention to limit the invention to use with turbofans as use with other types of gas turbine engines is contemplated.

As shown in FIG. 1, engine 100 incorporates a fan 102, a compressor section 104, a combustion section 106 and a turbine section 108. Notably, turbine section 108 includes alternating rows of stationary vanes 110, which are formed by multiple vane assemblies in an annular arrangement, and rotating blades 112. Note also that due to the location of the blades and vanes downstream of the combustion section, the blades and vanes are exposed to high temperature conditions during operation.

Figure 2:
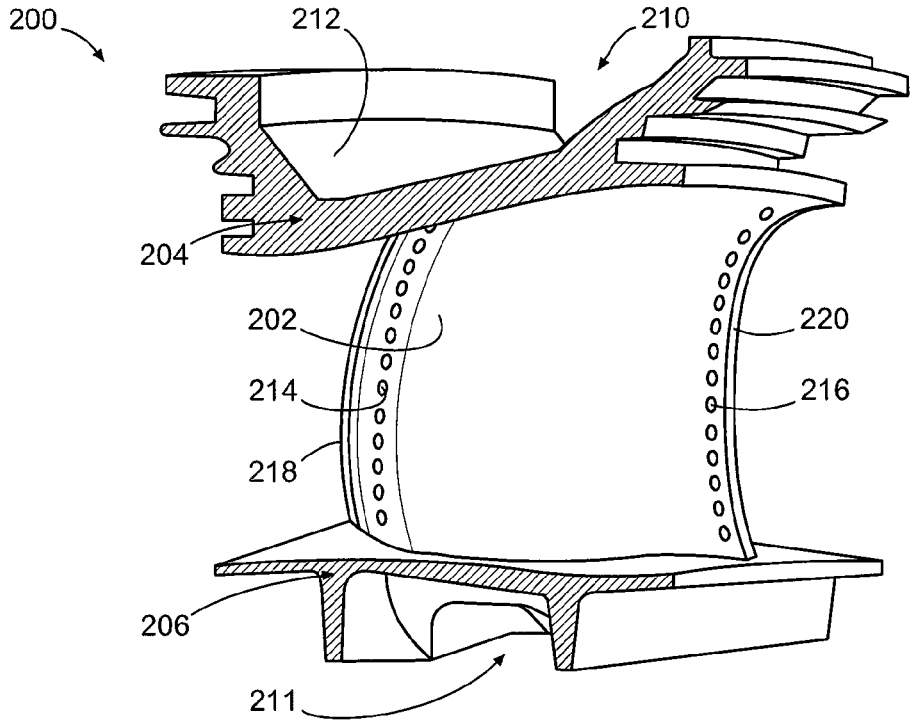
FIG. 2 is a schematic view of an embodiment of a turbine vane assembly.

A representative embodiment of a vane assembly is depicted schematically in FIG. 2. As shown in FIG. 2, vane assembly 200 incorporates a vane 202, outer platform 204 and inner platform 206. Vane 202 is generally configured as an airfoil that extends from outer platform 204 to inner platform 206. Outer platform 204 attaches the vane assembly to a turbine casing, and inner platform 206 may attach the other end of the vane assembly so that the vane is securely positioned across the turbine gas flow path.

In order to cool the vane airfoil and platforms during use, cooling air is directed toward the vane assembly. Typically, the cooling air is bleed air vented from an upstream compressor. In the embodiment depicted in FIG. 2, cooling air is generally directed through a cooling air plenum 210 defined by the non-gas flow path structure 212 of the platform and static components around the vane. From the cooling plenum, cooling air is directed through a cooling cavity (not shown) that is located in the interior of the vane. From the cooling cavity, the cooling air is passed through the vane to secondary cooling systems and/or vented to the turbine gas flow path located about the exterior of the vane. Specifically, the cooling air may be vented through cooling holes (e.g., holes 214, 216) that interconnect the cooling cavity and an exterior of the vane. Typically, the cooling holes are located along the leading edge 218 and trailing edge 220 of the vane although various other additional or alternative locations can be used.

Typically the vane outer platform 204 is cooled by directing air from the plenum 210 through small holes in a plate producing jets of cooling air, which impinge upon the non-gas flow path side of the platform, and/or by drilling cooling holes directly through the platform. Typically, the vane inner platform 206 is cooled in a manner similar to the outer platform. Cooling air for the inner platform may be directed from plenum 211.

Additionally or alternatively, cooling of a vane assembly can be provided via a platform cooling channel. An embodiment of a platform cooling channel is depicted schematically in FIGS. 3 and 4. Specifically, platform 300 includes a land 302 and a cooling surface 304. A platform cooling channel 306 is defined, at least in part, by the cooling surface 304 and a channel cover. In this embodiment, an underside of channel cover 312 forms a channel wall, and the bottom of a recess 310 forms the cooling surface.

Figure 3:
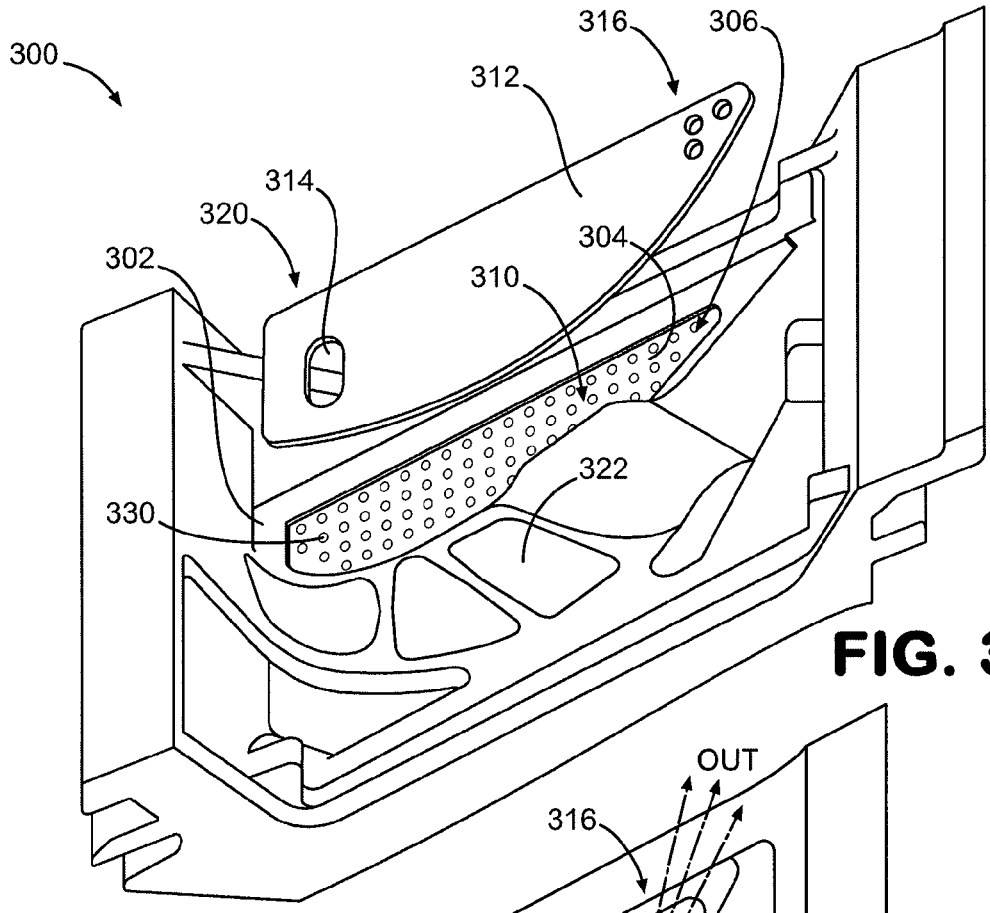
FIG. 3 is a schematic view of an embodiment of a turbine vane platform showing detail of a representative cooling channel.

Channel cover 312 is shaped to conform to at least a portion of the non-gaspath static structure of the platform. In the embodiment of FIG. 3, the channel cover is formed as a plate and is substantially planar. Channel cover 312 includes a cooling air inlet 314, fed by high pressure cooling air from plenum 320. Although the inlet 314 is depicted as one opening, various sizes, shapes and/or numbers of openings can be used in other embodiments. Cooling channel exit holes are located in a region of lower pressure. Such a region can include, for example, the turbine gas flow path and/or a cavity formed by the vane platform and other adjacent static turbine components.

In this embodiment, the channel cover 312 is wider at the upstream side than at the downstream side. Although the shape along the length of a channel cover can vary, as may be required to accommodate the shape of the base of the platform, for example, this overall tapered shape may enhance airflow by creating a region of accelerated flow. Channel cover 312 is received by mounting land 302 that facilitates positioning of the channel cover on the non-gaspath static structure. Notably, various attachment methods can be used for securing the channel cover, such as brazing or welding.

In operation, cooling air (arrows "IN") provided to the platform via platform cooling air plenum 320 enters the cooling air inlet 314 and flows through the platform cooling channel 306. The cooling air (arrows "OUT") exits the cooling channel via holes 316. Although additional cooling need not be provided, in the embodiment of FIGS. 3 and 4, vane cooling inlets 322 are provided in the platform for directing additional cooling air. In particular, the vane cooling inlets permit additional cooling air to enter an interior cavity of a vane airfoil. From the cavity (not shown), this cooling air extracts heat from the vane and is then passed through the vane to secondary cooling systems and/or expelled through holes located along the turbine gas flow path, such as described before with respect to the embodiment of FIG. 2.

Note also in FIG. 3 that cooling surface 304 incorporates cooling features in the form of protrusions 330. In addition to increasing the effective surface area of the cooling surface, the protrusions tend to obstruct and/or otherwise disturb the flow of cooling air through the cooling channel 306, thereby further enhancing convective cooling. In this embodiment, the protrusions 330 extend outwardly from the cooling surface, with at least some of the protrusions not being in contact with the channel cover.

Figure 4:
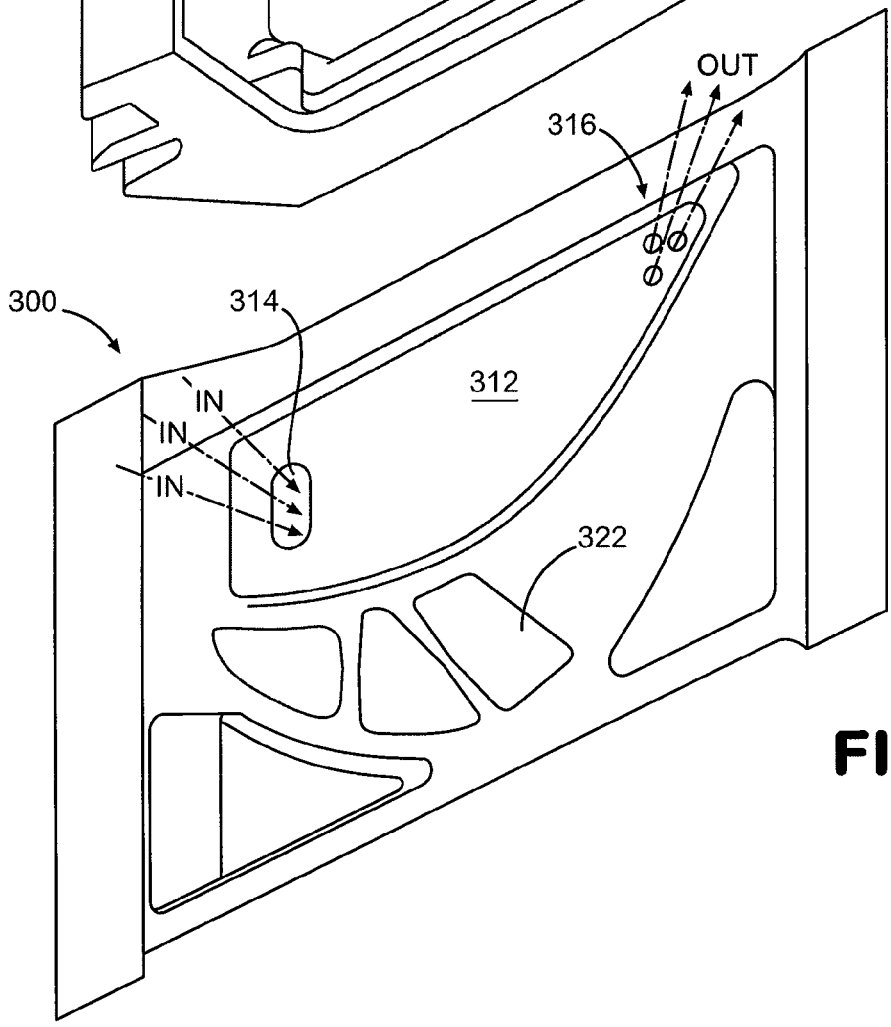
FIG. 4 is a schematic view of the embodiment of FIG. 3 showing the channel cover mounted to the platform land.
Figure 5:
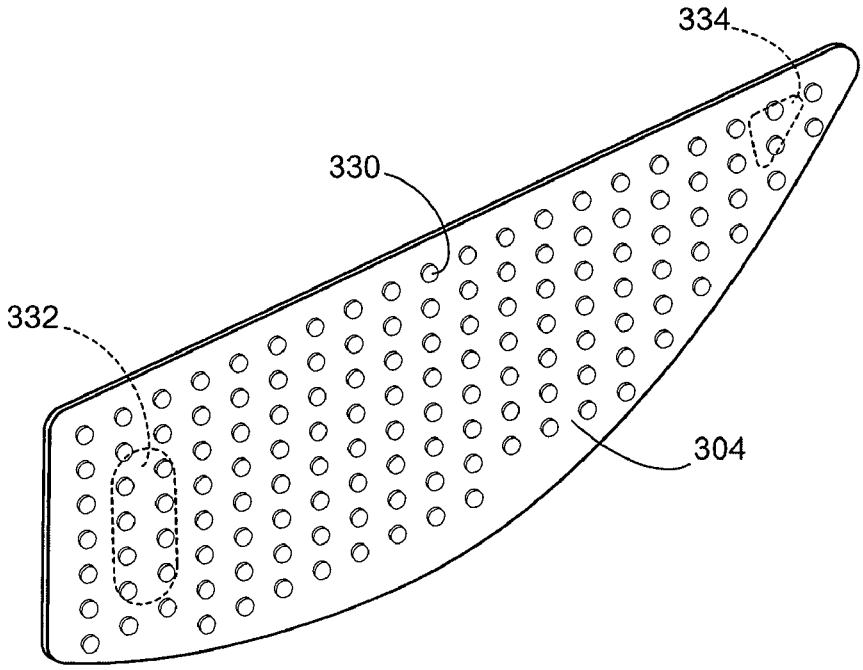
FIG. 5 is a schematic, plan view of representative surface cooling features.

The cooling surface 304 and protrusions 330 of the embodiment of FIGS. 3 and 4 are shown in greater detail in the plan view of FIG. 5. In FIG. 5, the dashed lines 332 and 334 represent possible locations of cooling air inlet 314 and cooling air outlet holes 316, respectively, which can be drilled through the channel cover 312.

Each protrusion of this embodiment is cast, or otherwise molded and, as such, exhibits a somewhat tapered profile. Notably, the tapering of the protrusions in this embodiment permits release of the cast cooling surface features from the mold used to form the protrusions.

Figure 6:
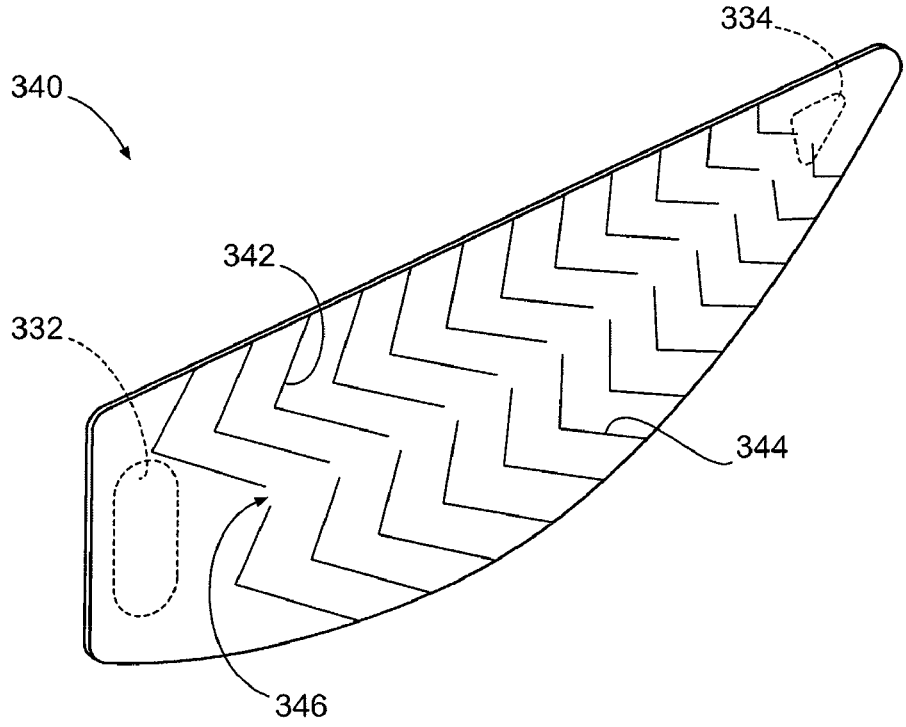
FIG. 6 is a schematic, plan view of other representative surface cooling features.

An alternative embodiment of cooling features is depicted schematically in the plan view of FIG. 6. As shown in FIG. 6, the protrusions are configured as trip strips that are arranged to disrupt the flow of cooling gas through the cooling channel. The trip strips extend from the cooling surface, with at least some of the trip strips not being tall enough to contact the channel wall formed by the channel cover. In this embodiment, the trip strips are arranged as spaced pairs of chevrons. For example, a pair 340 comprises a chevron 342 and a chevron 344, with a space 346 being located therebetween.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

The invention claimed is:

1. A gas turbine engine comprising:

a compressor section;

a combustion section located downstream of the compressor section;

a turbine section located downstream of the combustion section and having multiple vane assemblies;

a first of the vane assemblies having a platform and a vane airfoil, the platform having a vane mounting surface and a cooling channel; and the cooling channel being defined by a cooling surface and a substantially planer, plate-shaped channel cover, the channel cover being wider at an upstream side than at a downstream side, the channel cover being spaced from the cooling surface, the cooling surface being positioned between a gas flow path of the vane and the channel cover, the channel having a cooling air inlet located in a high pressure region of the platform and in said channel cover upstream side and a cooling air outlet located in a low pressure region of the platform and in said channel cover downstream side such that, during operation, cooling air flows into the cooling air inlet, through the cooling channel and out of the cooling air outlet without flowing into the vane airfoil.

2. The gas turbine engine of claim 1, wherein the cooling surface has protrusions extending therefrom.

3. The gas turbine engine of claim 2, wherein at least one of the protrusions is a trip strip having an outer edge spaced from a channel wall, the trip strip being operative to disrupt the flow of cooling air through the cooling air channel.

4. The gas turbine engine of claim 3, wherein the trip strip, in plan view, is configured as a chevron.

5. The gas turbine engine of claim 2, wherein a channel wall is formed, at least in part, by the channel cover.

6. The gas turbine engine of claim 1, wherein:

the combustion section and the turbine section define a turbine gas flow path along which combustion gasses travel;

the vane has an interior cooling cavity and cooling holes communicating with the cooling cavity; and the vane platform has a vane cooling inlet communicating with the cooling cavity such that additional cooling air enters the vane cooling inlet, is directed through the interior cooling cavity, and exits the cooling holes of the vane to enter the turbine gas flow path.

7. The gas turbine engine of claim 1, wherein:

the engine further comprises a casing to which the vane platform is mounted; and the cooling cover is located adjacent the interior of the casing.

8. A gas turbine vane assembly comprising:

a vane platform having a vane mounting surface and a cooling channel;

a vane airfoil extending outwardly from the platform; and the cooling channel being defined by a cooling surface and a substantially planer, plate-shaped channel cover, the channel cover being wider at an upstream side than at a downstream side, the channel cover being spaced from the cooling surface and located such that the cooling surface is positioned between a gas flow path of the vane airfoil and the channel cover, the channel having a cooling inlet located in a high pressure region of the platform and in the channel cover upstream side and a cooling outlet located in a low pressure region of the platform and in the channel cover downstream side such that during operation, cooling air flows into the cooling inlet, through the cooling channel and out of the cooling outlet without flowing into the vane airfoil.

9. The vane assembly of claim 8, wherein the cooling surface has protrusions extending therefrom.

10. The vane assembly of claim 9, wherein at least one of the protrusions is a trip strip having an outer edge spaced from a channel wall, the trip strip being operative to disrupt the flow of cooling air through the cooling channel.

11. The vane assembly of claim 10, wherein the trip strip, in plan view, is configured as a chevron.

12. The vane assembly of claim 8, wherein a channel wall is formed, at least in part, by the channel cover attached to the platform.

13. The vane assembly of claim 8, wherein:

the vane has an interior cavity and cooling holes communicating with the cooling cavity; and the vane platform has a vane cooling inlet communicating with the interior cavity.

14. The vane assembly of claim 13, wherein the platform is configured such that cooling air entering the cooling channel does not mix with cooling air entering the interior cavity of the vane.

15. A method for cooling a vane platform comprising:

providing a cooling channel on a platform from which a vane airfoil extends, the cooling channel being defined by a cooling surface and a substantially planer, plate-shaped channel cover, the channel cover being wider at an upstream side than at a downstream side, the channel cover being spaced from the cooling surface and located such that the cooling surface is positioned between a gas flow path of the vane and the channel cover; and directing a flow of cooling air through the cooling channel through an inlet in the channel cover upstream side and out the cooling channel through an outlet in the channel cover downstream side without flowing the cooling air into the vane such that heat is extracted from the cooling surface of the platform by the flow of cooling air.

16. The method of claim 15, further comprising impingement cooling the platform.

17. The method of claim 15, further comprising film cooling the platform.

18. The method of claim 15, wherein:

the flow of cooling air is a first flow of cooling air; and the method further comprises directing a second flow of cooling air through the vane.

19. The method of claim 15, further comprising disrupting the flow of cooling air within the cooling channel.

20. The method of claim 15, further comprising expelling the flow of cooling air from the cooling channel downstream of the vane.

* * * * *

UNITED STATES PATENT AND TRADEMARK OFFICE

CERTIFICATE OF CORRECTION

PATENT NO. : 8,016,546 B2
APPLICATION NO. : 11/782001
DATED : September 13, 2011
INVENTOR(S) : Surace et al.

It is certified that error appears in the above-identified patent and that said Letters Patent is hereby corrected as shown below:

IN THE CLAIMS:

Claim 1, Column 4, line 49, “planer” should read as --planar--

Claim 8, Column 5, line 26, “planer” should read as --planar--

Claim 15, Column 6, line 18, “planer” should read as --planar--

Signed and Sealed this
Eighteenth Day of March, 2014

Michelle K. Lee

Michelle K. Lee
*Deputy Director of the United States Patent and Trademark Office*